US005419100A

United States Patent [19]

Gwiazdon et al.

[11] Patent Number: 5,419,100

[45] Date of Patent: May 30, 1995

[54] APPARATUS FOR COLLAPSING MICROWAVE POPCORN BAGS HELD IN A FIXTURE

[75] Inventors: Rodney K. Gwiazdon, St. Louis Park, Minn.; John E. Korte, Cedar Rapids, Iowa; Richard S. Deadmond, West Bend, Wis.; Frank C. Starr, New Berlin, Wis.; Robert D. Devlin, Milwaukee, Wis.

[73] Assignee: General Mills, Inc., Minneapolis, Minn.

[21] Appl. No.: 164,743

[22] Filed: Dec. 10, 1993

[51] Int. Cl.[6] ..... B65B 7/08

[52] U.S. Cl. ..... 53/482; 53/375.7

[58] Field of Search ..... 53/482, 481, 480, 375.5, 53/375.7, 370.2, 284.7, 371.7, 372.5

[56] References Cited

U.S. PATENT DOCUMENTS

| | | | |
|---|---|---|---|
| 2,364,543 | 12/1944 | Moore | 53/482 |
| 2,925,695 | 2/1960 | Fry | 53/482 |
| 3,462,070 | 8/1969 | Corella | 229/56 |
| 3,570,751 | 3/1971 | Trewella | 229/66 |
| 3,608,709 | 9/1971 | Pike | 206/219 |
| 3,615,711 | 10/1971 | Markus et al. | 229/66 |
| 3,720,559 | 3/1973 | Odom et al. | 53/482 X |
| 4,019,305 | 4/1977 | McGhie et al. | 53/482 X |
| 4,257,209 | 3/1981 | Tetenborg et al. | 53/375.7 |
| 4,257,210 | 3/1981 | Tetenborg et al. | 53/375.7 |
| 4,337,862 | 7/1982 | Suter | 206/632 |
| 4,450,180 | 5/1984 | Watkins | 426/107 |
| 4,548,826 | 10/1985 | Watkins | 426/394 |
| 4,691,374 | 9/1987 | Watkins et al. | 383/104 |
| 4,735,513 | 4/1988 | Watkins et al. | 383/116 |
| 4,878,765 | 11/1989 | Watkins et al. | 383/116 |
| 4,890,439 | 1/1990 | Smart et al. | 53/410 |
| 5,044,777 | 9/1991 | Watkins et al. | 383/100 |
| 5,171,950 | 12/1992 | Brauner et al. | 219/10.55 E |

OTHER PUBLICATIONS

SIG Pouch Packaging Machine Type RF; SIG Swiss Industrial Company, CH-8212 Neuhausen Rhine Falls, Packaging Technology Division; Raymond Automation Company, Inc., Norwalk, Conn. (no date).

*Primary Examiner*—James F. Coan

*Attorney, Agent, or Firm*—L. MeRoy Lillehaugen; John A. O'Toole; Alan D. Kamrath

[57] ABSTRACT

An apparatus (10) is disclosed including an abutment (282) in the form of an elongated rod positioned in front of the sealing intermittent position which rearwardly deflects the portions of bags (12) extending out of fixtures (32) moving in an operation direction. The bags (12) then slap forwardly against a stop (284) as the fixtures (32) reach the sealing intermittent position, with the stop (284) being in the form of a plate carried by the sealing jaw (146) of the sealing position. Arms (136) are pivoted between a transport position spaced from the fixtures (32) and a compression position to engage a rod (138) with the bags (12) above an expansion prevention bar (49) of the fixtures 32 to deflect the product located in the bags (12) into a more planar condition.

24 Claims, 1 Drawing Sheet

APPARATUS FOR COLLAPSING MICROWAVE POPCORN BAGS HELD IN A FIXTURE

BACKGROUND

The present invention generally relates to apparatus for collapsing bags, particularly to apparatus for collapsing bags for food products, more particularly to apparatus for collapsing bags held in a fixture, and specifically to apparatus for collapsing microwave popcorn bags held in a fixture.

Popcorn is a highly popular snack food item. In the past, the at-home preparation of popcorn by the consumer involved adding kernel popcorn plus a cooking oil to a covered pot and heating until the popcorn kernels popped to make popcorn. As used herein, "kernel popcorn" refers to unpopped popcorn. The noun "popcorn" or synonymously "popped popcorn" refers herein to popped kernel popcorn. The adjective "popcorn" can refer to either.

More recently, microwave popcorn products have become extremely popular. At present, in the United States of America, over 70 different brands of microwave popcorn products are available. In general, the more popular microwave popcorn products comprise an expandable paper bag containing a charge of kernel popcorn, fat and salt. The microwave popcorn article is adapted to be heated in a microwave oven for three to five minutes to produce the popped popcorn. More recently, improved microwave popcorn articles have been fabricated employing a metallized susceptor which facilitates the heating of the popcorn-fat charge and which, in turn, leads desirably to increases in popcorn volume and decreases in unpopped kernels. Microwave popcorn articles of this type are described in detail in, for example, U.S. Pat. No. 4,450,180 (issued May 22, 1984 to J. D. Watkins and incorporated herein by reference).

The prior art is replete with various apparatus and methods for filling and sealing microwave popcorn bags and in some cases folding the bag generally into a central portion having first and second wing portions extending from opposite ends thereof from folds. For example, U.S. Pat. Nos. 4,450,180; 4,548,826; 4,604,854; and 5,171,950 show techniques for filling and sealing microwave popcorn bags. Particularly, the charge of popcorn, fat and salt could be dropped as a prefabricated toroid- or doughnut-shaped piece into an open end of the bag prior to its sealing. More recently, the popcorn, fat in the form of a slurry, and salt are filled in the open end of the bag prior to its sealing. However, changes in the marketing of microwave popcorn have created demand for improved techniques for collapsing microwave popcorn bags held in a fixture. Specifically, with the increasing competitiveness of the microwave popcorn business, a need exists for apparatus and methods which achieve higher output speeds in "bags per minute" while reducing the amount of labor, downtime, and floor space required. Additionally, with the reduction in the amount of material and/or layers utilized in the formation of paper popcorn packages including a microwave susceptor such as shown and described in International Publication No. WO 93/15976 published on Aug. 19, 1993, a need exists for apparatus and methods which are capable of running bags of flimsy construction as well as reducing product and material damage. Additionally, with the introduction of various types and sizes of bags to meet particular market types and conditions and for enhancing product performance, a need exists for apparatus and methods which are capable of handling different sizes of bags such as single or multiple serving sizes, and/or different types such as gusseted or non-gusseted bags, and/or different configurations of bags.

SUMMARY

The present invention solves these needs and other problems in the field of opening microwave popcorn bags or the like by providing, in the most preferred form, an abutment deflecting the bottom and top of a bag above a fixture as the fixture moves in an operation direction past the abutment, with the portions of the bag above the fixture returning to an undeflected condition after the unsealed end passes the abutment and the unsealed end slapping against a stop as the fixture reaches an intermittent position.

In other aspects of the present invention, a rod extends from a first arm pivotable about an axis spaced from and allowing a fixture and a bag to move in a nonabutting manner in an operation direction, with the rod in a transport position spaced from the fixture and the bag allowing the fixture and the bag to move in a lane in the operation direction without abutment, with the rod engaging the bottom of the bag when the first arm moves from the transport position towards a compressing position, with the bag sandwiched between the fixture and the rod when the first arm is in the compressing position.

It is thus an object of the present invention to provide a novel apparatus for collapsing bags.

It is further an object of the present invention to provide such a novel bag-collapsing apparatus achieving higher output speeds in "bags per minute" than current technology.

It is further an object of the present invention to provide such a novel bag-collapsing apparatus providing positive control of the bags.

It is further an object of the present invention to provide such a novel bag-collapsing apparatus capable of running various types and sizes of bags including gusseted and non-gusseted bags, multi- or single-ply paper bags, or bags of flimsy-type structure.

It is further an object of the present invention to provide such a novel bag-collapsing apparatus which is very compact, minimizing floor surface and work space required.

It is further an object of the present invention to provide such a novel bag-collapsing apparatus which is easily accessible from the floor for trouble shooting, maintenance, and the like.

It is further an object of the present invention to provide such a novel bag-collapsing apparatus allowing easy changeover for different sized bags and for reducing down time.

It is further an object of the present invention to provide such a novel bag-collapsing apparatus reducing product loss.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
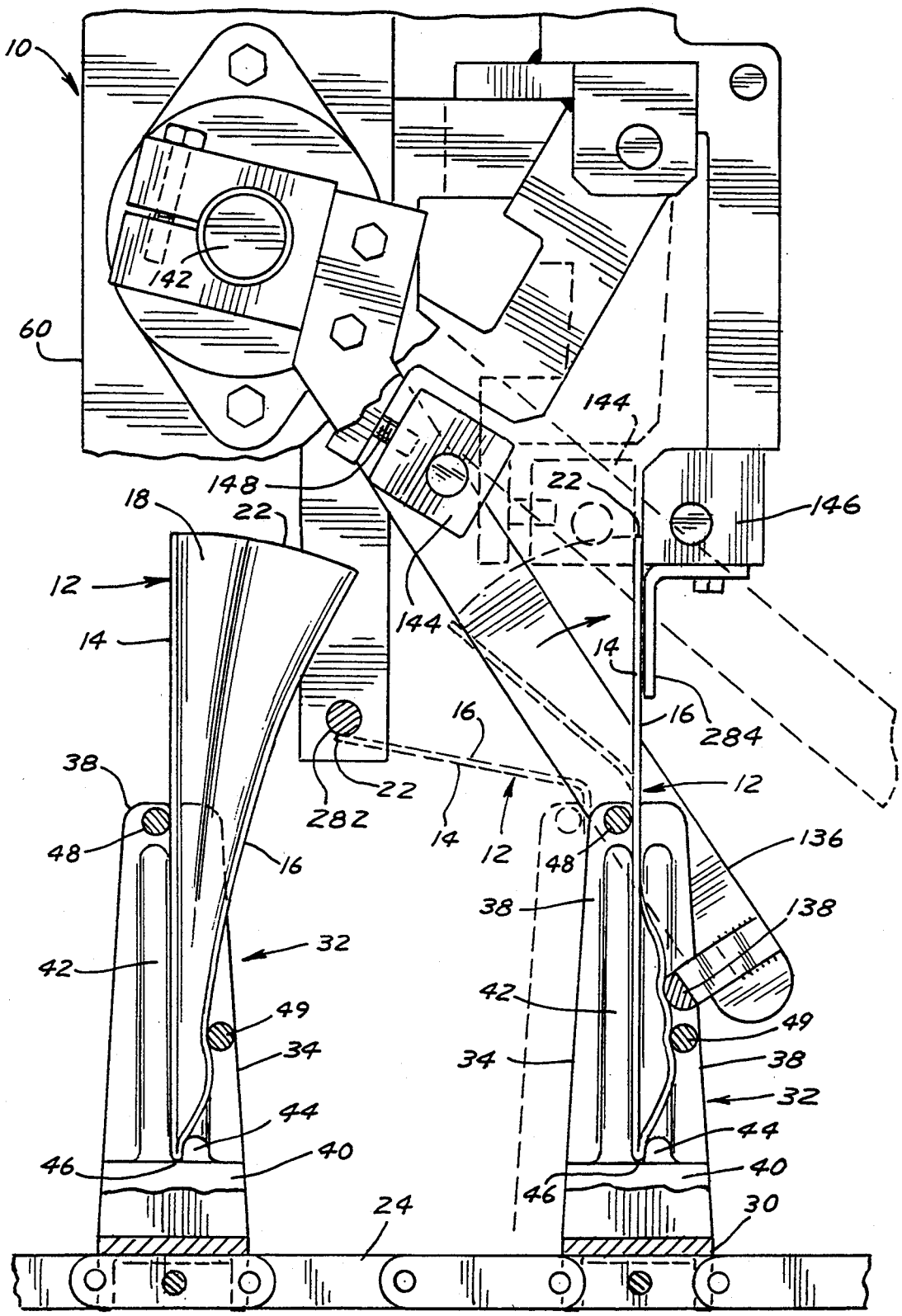
FIG. 1 shows a cross sectional view of a microwave popcorn bag collapsing device according to the preferred teachings of the present invention.

The figure is drawn for ease of explanation of the basic teachings of the present invention only; the extensions of the Figure with respect to number, position relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the Figure of the drawings, the same numerals designate the same or similar parts. Furthermore when the terms "top", "bottom", "first", "second", "front" "back", "rear", "upper", "lower", "height", "width", "end" "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

An apparatus for collapsing bags 12 according to the preferred teachings of the present invention is shown in the drawings and generally designated 10. In the most preferred form, bags 12 are of the current type for the marketing of microwave popcorn and each include a top 14, a bottom 16 including the microwave susceptor, first and second gusseted sides 18, a first, lower, sealed end, and a second, upper, unsealed end 22. In the most preferred form, bottom 16 has a width less than top 14. Each side 18 includes a top gusset pivotally connected to top 14 about a fold line and includes a bottom gusset pivotally connected to bottom 16 about a fold line and also pivotally connected to the corresponding top gusset. It should be noted that bags 12 can be of other types and varieties than bags 12 as shown, such as but not limited to bags 12 where top 14 and bottom 16 are of equal or different widths, nongusseted bags 12, or the like. Also, bags 12 can be formed of various types of materials including paper of either multi-ply or single-ply variety, plastic, and like materials including flimsy-type materials.

Apparatus 10 generally includes at least first and second roller chains 24 arranged as closed loops extending around sprockets. Multiple carrier bars 30 are provided including first portions secured to roller chains 24 at equal circumferential spacing along the closed loops. Each carrier bar 30 includes a second portion having a plurality of bag-holding fixtures 32 secured thereto corresponding to the number of lanes of bags 12 which are being filled and sealed in apparatus 10, with 4 lanes being provided in apparatus 10 and 4 fixtures 32 being provided on each carrier bar 30 in the preferred form. The first and second portions of bars 30 are removably secured together such as by bolts. It can then be appreciated that changeover for different sized bags can be easily accomplished and/or down time is reduced in the event of fixture contamination, breakage, or the like by simply replacing the second portions of bars 30 with fixtures 32 secured thereon. Any cleaning or repair can be accomplished while the second portions of bars 30 and fixtures 32 secured thereon are removed from apparatus 10 and as apparatus 10 continues to operate with other, replacement, second portions of bars 30 and fixtures 32 secured thereon being secured to the first portions of bars 30 secured to roller chains 24.

In the most preferred form, fixtures 32 each include first and second fixture halves 34 secured in a spaced relation to the second portions of bars 30 by suitable means such as bolts. Each half 34 includes a side plate 38 and a bottom plate 40 extending generally perpendicular to the bottom ends of plate 38. Each half 34 further includes a support plate 42 of a generally rectangular configuration and extending generally perpendicular to side plates 38 and bottom plate 40. Each half 34 further includes an abutment 44 of a generally L-shaped configuration having a first leg secured and extending generally perpendicular to plate 38 and a second leg secured to and extending generally perpendicular to plate 40. In the most preferred form, the first and second legs of abutment 44 include an arcuate portion at their interconnection. Abutment 44 has arcuate inside edges and provides a camming surface opposite to support plate 42. Support plate 42 and abutment 44 are generally parallel and spaced from each other and form a slot 46 therebetween for receiving the side edges of bag 12. Side plates 38 further include bores for slideably receiving the ends of a folding bar 48, with bar 48 being captured in the bores of side plates 38 of the first and second fixtures halves 34 forming each fixture 32. The forward extent of bar 48 is generally equal to the forward extent of support plates 42 of halves 34 of fixtures 32. The first legs of abutment 44 include bores for slideably receiving the ends of an expansion prevention bar 49, with bar 49 being captured in the bores of abutment 44 of the first and second fixture halves 34 forming each fixture 32.

It can then be appreciated that as roller chains 24 move around the sprockets, bars 30 and fixtures 32 carried thereby are positioned along the closed loop arrangement of roller chains 24, with chains 24 being movable in an operation direction intermittently by any suitable means in the most preferred form.

After bags 12 have been filled with the desired product such as popcorn kernels, grease or oil, or the like, bags 12 in fixtures 32 are advanced to the sealing positions, with two sealing positions being utilized in the most preferred form. In the most preferred form, as the product in bag 12 will tend to hold end 22 open and top 14 and bottom 16 at a non-parallel angle to each other, bags 12 are collapsed and air is forced therefrom prior to the first sealing operation. Particularly, an elongated abutment rod 282 is horizontally positioned across apparatus 10 at a height slightly above the height of fixtures 32 at a distance less than the spacing of end 22 from fixtures 32 and at a spacing in front of the first sealing intermittent position generally equal to but slightly more than the height or spacing of bags 12 above fixtures 32. A flat plate stop 284 is horizontally positioned across apparatus 10 at a height to abut with bag 12 adjacent to end 22. Stop 284 is positioned to be coextensive with slots 46 of fixtures 32 in the first sealing intermittent position. In operation and while the fixtures 32 are moving from the intermittent position just prior to the first sealing intermittent position, bottoms 16 of bags 12 engage with rods 282. Further movement of fixtures 32 and bags 12 held therein causes tops 14 to continue to move forward while bottoms 16 are held stationary by rods 282 until bottoms 16 deflect into a generally collapsed position against tops 14. Further movement of fixtures 32 and bags 12 held therein causes the portions of bags 12 above fixtures 32 with bottoms 16 collapsed against top 14 to further deflect rearwardly in a direction opposite to the operation direction generally about folding bar 48 due to the abutment of bottoms 16 with rod 282. Further movement of fixtures 32 and bags 12 held therein toward the first sealing intermittent position causes end 22 to pass rod 282. With bottom 16 no longer being abutted, the portions of bags 12 above fixtures 32 will return to a linear condition with the portions of bags 12 within fixtures 32 due to the memory of the material forming bags 12. Stop 284 abuts with bottoms 16 just as fixtures 32 reach the first sealing intermittent position and the upper portions of bags 12 reach their linear condition with the portions of bags 12 within fixtures 32. Due to the slapping action of the portions of bags 12 above fixtures 32 moving from the bent to linear positions against stop 284 while fixtures 32 are still moving, tops 14 and bottoms 16 will be in a collapsed condition when abutting with stop 284.

Further, generally J-shaped arms 136 are positioned on opposite sides of apparatus 10 and each include a first leg and a second leg. A rod 138 extends between the free ends of the second legs of arms 136. Arms 136 are pivotally mounted about a pivot axis in the form of a shaft 142 extending generally parallel to rod 138 and adjacent to and extending between the first legs of arms 136, with axis 142 extending generally perpendicular to the operation direction of fixtures 32 and spaced in the operation direction behind fixtures 32 and tops 14 and bottoms 16 of bags 12 in the first sealing intermittent position and spaced above bags 12 allowing fixtures 32 and bags 12 held therein to move in a nonabutting position therewith. Arms 136 are pivoted between a transport position and a compressing position. In the transport position, rod 138 is located above fixtures 32 and bags 12 held therein allowing carrier bars 30 and fixtures 32 mounted thereto to move under rod 138. When pivoted from its transport position, rod 138 travels along an arc to its compressing position and engages with bottoms 16 at a vertical location intermediate the vertical extent of fixtures 32 and sandwiches bottom 16 against sides 18 and top 14 and in the most preferred form above bars 49 of fixtures 32. It should then be noted that rod 138 deflects the product located within the bulges of bags 12 to a more planar condition to reduce the overall height between tops 14 and bottoms 16 of bags 12 in their final commercial form.

With bags 12 sandwiched between rod 138 and fixtures 32 and abutting with stop 284, first and second heat sealing jaws 144 and 146 are lowered and clamp bags 12 adjacent end 22 for sealing end 22. In the preferred form, stop 284 is mounted to and carried with jaw 146 and slides downwardly on bottoms 16 towards fixtures 32 when jaws 144 and 146 are lowered to their sealing position. Further, in the most preferred form, jaws 144 are biased by springs 148. It can then be appreciated that suitable sensors can be provided to detect if end 22 has been properly sealed. After sealing, jaws 144 and 146 are separated and positioned above bags 12, and arms 136 are pivoted from the compressing position to the transport position. Then, carrier bars 30 and fixtures 32 mounted thereon and bags 12 held therein are moved to the next, intermittent sealing position where first and second heat sealing, silicone foam covered jaws clamp bags 12 adjacent end 22 for again sealing end 22.

When bags 12 are utilized for holding microwave popcorn, it can be appreciated that bags 12 can be loaded into fixtures 32 in a folded condition such as into Δ-⅔ portions in the most preferred form, with the fold line between the portions of bags 12 abutting with bottom plates 40 inside of slot 46 of fixture 32. After filling and sealing, bags 12 can then be further folded into their commercialized form.

It should be appreciated that various overload protection devices can be utilized to stop operation of apparatus 10 or a particular station thereof in the event of a jam or other interruption in the collapsing operation.

Now that the basic construction and operation of apparatus 10 according to the preferred teachings of the present invention have been explained, many extentions and variations may be obvious to a person skilled in the art. For example, although fixtures 32 have been shown and described as being formed of nonmovable parts, fixtures 32 can be of a hinged type which include legs which are openable and closeable. For example, the legs could be biased by springs to a normally closed position and can be cammed open against the bias of the springs. Vacuum suction cups could be provided to the legs of the fixtures to attach to the bag surfaces for opening with bags when the legs are hinged open, with the suction cups being continuously under vacuum or intermittently under vacuum only in the task positions where opening of the bag is desired. The legs of fixtures 32 can be shaped to correspond to the filled shape of bags 12.

Likewise, fixtures 32 could include a spring or like clamping member which sandwiches bags 12 in fixtures 32 to prevent bags 12 from slipping out of fixtures 32 during movement of fixtures 32 about the closed loops of chains 24. Suitable apparatus such as suction cups may be necessary to pull back such spring or clamping member during removal operations.

Although bags 12 have been described in the most preferred form as microwave popcorn popping bags 12 and specifically are folded into a central portion having first and second wing portions and in the most preferred form into thirds, bags 12 could be loaded into fixtures 32 in an unfolded condition where bags 12 are not desired to be folded in the final form. Similarly, bags 12 could be filled with other types of product than popcorn kernels such as but not limited to baking ingredients such as cake mixes, sauces such as catsup, and the like.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for collapsing a bag having a top, a bottom and an unsealed end, with the bag held in a fixture, with the fixture including means for supporting the top spaced from the unsealed end, with the fixture and the bag held therein being movable in a lane in an operation direction generally perpendicular to the top and bottom and stopping at an intermittent position, with the unsealed end being open and the top and bottom extending at a non-parallel angle to each other, with the unsealed end being at a spacing from the fixture, comprising, in combination: an abutment positioned above the fixture moving in the operation direction at a distance less than the spacing and in front of the intermittent position at a distance from the fixture generally equal to but slightly larger than the spacing, with the abutment deflecting the bottom and top above the fixture in a direction opposite to the operation direction as the fixture moves in the operation direction past the abutment; and a stop positioned at the intermittent position and at a height to abut with the bag adjacent to the unsealed end, with the portions of the bag above the fixture returning to an undeflected condition after the unsealed end passes the abutment and the unsealed end slapping against the stop as the fixture reaches the intermittent position.

2. The collapsing device of claim 1 wherein the abutment comprises an elongated rod extending generally perpendicular to the operation direction.

3. The collapsing device of claim 2 wherein the stop comprises a flat plate generally perpendicular to the operation direction.

4. The collapsing device of claim 3 wherein the stop is carried with a sealing jaw for sealing the unsealed end of the bag.

5. The collapsing device of claim 4 wherein the means for supporting the top includes a folding bar extending generally perpendicular to the operation direction.

6. The collapsing device of claim 5 further comprising, in combination: at least a first arm; means for pivoting the first arm about an axis extending generally perpendicular to the operation direction and spaced in the operation direction behind the bottom of the bag and spaced from the bag allowing the fixture and the bag to move in a nonabutting position with the arm axis; and a rod extending from the first arm parallel to and spaced from the arm axis, with the first arm being pivotal between a transport position and a compressing position, with the rod in the transport position spaced from the fixture and the bag allowing the fixture and the bag to move in the lane in the operation direction without abutment, with the rod engaging the bottom of the bag when the first arm moves from the transport position towards the compressing position, with the bag sandwiched between the top supporting means and the rod when the first arm is in the compressing position.

7. The collapsing device of claim 6 wherein the bag includes side edges, with the fixture including first and second abutments in a spaced arrangement generally perpendicular to the operation direction for abutting with the side edges of the bag, and wherein the fixture further includes an expansion prevention bar extending between the first and second abutments generally perpendicular to the operation direction, with the rod engaging the bottom of the bag above the expansion prevention bar.

8. The collapsing device of claim 1 wherein the stop comprises a flat plate generally perpendicular to the operation direction.

9. The collapsing device of claim 8 wherein the stop is carried with a sealing jaw for sealing the unsealed end of the bag.

10. The collapsing device of claim 1 wherein the stop is carried with a sealing jaw for sealing the unsealed end of the bag.

11. The collapsing device of claim 1 further comprising, in combination: at least a first arm; means for pivoting the first arm about an axis extending generally perpendicular to the operation direction and spaced in the operation direction behind the bottom of the bag and spaced from the bag allowing the fixture and the bag to move in a nonabutting position with the arm axis; and a rod extending from the first arm parallel to and spaced from the arm axis, with the first arm being pivotal between a transport position and a compressing position, with the rod in the transport position spaced from the fixture and the bag allowing the fixture and the bag to move in the lane in the operation direction without abutment, with the rod engaging the bottom of the bag when the first arm moves from the transport position towards the compressing position, with the bag sandwiched between the top supporting means and the rod when the first arm is in the compressing position.

12. The collapsing device of claim 11 wherein the bag includes side edges, with the fixture including first and second abutments in a spaced arrangement generally perpendicular to the operation direction for abutting with the side edges of the bag, and wherein the fixture further includes an expansion prevention bar extending between the first and second abutments generally perpendicular to the operation direction, with the rod engaging the bottom of the bag above the expansion prevention bar.

13. The collapsing device of claim 1 wherein the means for supporting the top includes a folding bar extending generally perpendicular to the operation direction.

14. Device for collapsing a bag having a top, a bottom and an unsealed end, with the bag held in a fixture, with the fixture including means for supporting the top, with the fixture and the bag held therein being movable in a lane in an operation direction generally perpendicular to the top and bottom, comprising, in combination: at least a first arm; means for pivoting the arm about an axis extending generally perpendicular to the operation direction; and a rod extending from the first arm parallel to and spaced from the arm axis, with the first arm being pivotal between a transport position and a compressing position, with the rod in the transport position spaced from the fixture and the bag allowing the fixture and the bag to move in the lane in the operation direction without abutment, with the rod engaging the bottom of the bag when the first arm moves from the transport position towards the compressing position, with the bag sandwiched between the top supporting means and the rod when the first arm is in the compressing position.

15. The collapsing device of claim 14 wherein the bag includes side edges, with the fixture including first and second abutments in a spaced arrangement generally perpendicular to the operation direction for abutting with the side edges of the bag, and wherein the fixture further includes an expansion prevention bar extending between the first and second abutments generally perpendicular to the operation direction, with the rod engaging the bottom of the bag above the expansion prevention bar.

16. The collapsing device of claim 15 wherein the axis is spaced in the operation direction behind the bottom of the bag.

17. The collapsing device of claim 16 further comprising, in combination: a second arm, with the rod extending between the first and second arms, with the pivot axis being a shaft interconnecting the first and second arms and spaced from the bag allowing the fixture and the bag to move in a nonabutting position with the shaft.

18. The collapsing device of claim 14 wherein the axis is spaced in the operation direction behind the bottom of the bag.

19. The collapsing device of claim 18 further comprising, in combination: a second arm, with the rod extending between the first and second arms, with the pivot axis being a shaft interconnecting the first and second arms and spaced from the bag allowing the fixture and the bag to move in a nonabutting position with the shaft.

20. Method for collapsing an open, unsealed end of a bag having a top and a bottom extending at a non-parallel angle to each other comprising the steps of: supporting the top of the bag spaced from the unsealed end with the unsealed end being at a spacing from the top support; placing a deflecting force against the bottom towards the top and above the top support in a direction generally perpendicular to the top and bottom to deflect the bottom and top about the top support; removing the deflecting force allowing the bag to return to an undeflected condition; and slapping the unsealed end against a stop when the bag returns to the undeflected condition.

21. The method of claim 20 wherein the placing step comprises the steps of: moving the bag in a lane in an operation direction generally perpendicular to the top and bottom; and abutting the bottom of the bag moving in the operation direction at a distance from the top support less than the spacing.

22. The method of claim 21 wherein the removing step comprises the step of continuing to move the bag past the abutment to a distance in the operation direction larger than the spacing.

23. The method of claim 22 wherein the slapping step comprises the steps of: stopping the bag at an intermittent position; and positioning the stop at the intermittent position and at a height to abut with the bag adjacent to the unsealed end when the bag returns to the undeflected condition.

24. The method of claim 23 further comprising the step of moving a rod along an arc having an axis extending generally perpendicular to the operation direction between a transport position and a compressing position, with the rod in the transport position being spaced from the bag allowing the bag to move in the operation direction without abutment, with the rod engaging the bottom of the bag in the intermittent position when moving from the transport position towards the compressing position.

* * * * *